US006340803B1

(12) United States Patent
Li

(10) Patent No.: US 6,340,803 B1
(45) Date of Patent: Jan. 22, 2002

(54) COMPUTER KEYSWITCH

(75) Inventor: Tung Hsueh Li, Taipei (TW)

(73) Assignee: Silitek Corporation, Taipei (TW)

( * ) Notice: Subject to any disclaimer, the term of this patent is extended or adjusted under 35 U.S.C. 154(b) by 0 days.

(21) Appl. No.: 09/768,307

(22) Filed: Jan. 25, 2001

(51) Int. Cl.[7] ..... H01H 13/70
(52) U.S. Cl. ..... 200/344
(58) Field of Search ..... 200/5 A, 5, 7, 200/344, 345; 400/490, 491, 2, 495, 496

(56) References Cited

U.S. PATENT DOCUMENTS 5,878,872 A * 3/1999 Tsai ..... 200/344
5,898,145 A * 4/1999 Su ..... 200/344
6,040,540 A * 3/2000 Tsai et al. ..... 200/344
6,040,541 A * 3/2000 Li ..... 200/344
6,160,233 A * 12/2000 Hu ..... 200/344
6,183,150 B1 * 2/2001 Kao ..... 400/495
6,191,776 B1 * 2/2001 Hu ..... 345/168
6,194,677 B1 * 2/2001 Li ..... 200/344

* cited by examiner

*Primary Examiner*—Michael Friedhofer
(74) *Attorney, Agent, or Firm*—Rosenberg, Klein & Lee

(57) ABSTRACT

A computer keyswitch comprises clamping plate extended upward from the bottom plate thereof. The clamping plate is used to retain the upward motion of the pivotal shafts on bottom end of the two levers of the computer keyswitch. The position, orientation and height of the clamping plate have not limit such that the clamping plate has reduced thickness and height. Therefore, the computer keyswitch has lower height but with same level mechanism height and structural strength.

1 Claim, 5 Drawing Sheets

COMPUTER KEYSWITCH

FIELD OF THE INVENTION

The present invention relates to a computer keyswitch, especially to a computer keyswitch suitable for notebook computer, which has lower height but with same level mechanism height and structural strength.

BACKGROUND OF THE INVENTION

FIG. 1 shows a prior art computer keyswitch 10*a*, which comprises a keycap 11*a*, a resilient body 12*a*, a first lever 13*a*, a second lever 14*a*, a base 15*a* and a bottom plate 16*a*. The first lever 13*a* and the second lever 14*a* are in scissors arrangement and have pivotal shafts 17*a* and 18*a* on bottom ends thereof. The pivotal shafts 17*a* and 18*a* are pivotally retained below clamping plates 19*a* and 20*a* formed on topside of the base 15*a*. The top ends of the first lever 13*a* and the second lever 14*a* are connected to the bottom side of the keycap 11*a*. The first lever 13*a* and the second lever 14*a* form the level mechanism of the keyswitch and the resilient body 12*a* is placed within the movement stroke of the level mechanism. When the keycap 11*a* is guided by the level mechanism composed of the first lever 13*a*and the second lever 14*a* to move downward or upward, the resilient body 12*a* below the keycap 11*a* presses on a membrane circuit 21*a* or leaves the membrane circuit 21*a* to perform on and off operation of the membrane circuit 21*a*.

However, in above-mentioned computer keyswitch 10*a*, the pi pivotal shafts 17*a* and 18*a* of the first lever 13*a* and the second lever 14*a* should have sufficient thickness to ensure enough structural strength. The base 15*a* should have considerable thickness and the thickness thereof is much larger than that of the bottom plate 16*a*. Therefore, the clamping plates 19*a* and 20*a* formed on topside of the base 15*a* extend to a considerable height. Therefore, the height of the above-mentioned computer keyswitch 10*a* can not be reduced satisfactorily.

SUMMARY OF THE INVENTION

It is the object of the present invention to provide a computer keyswitch, which has lower height but with same level mechanism height and structural strength.

To achieve the above object, the computer keyswitch according to the present invention comprises clamping plate extended upward from the bottom plate thereof. The clamping plate is used to retain the upward motion of the pivotal shafts on bottom end of the two levers of the computer keyswitch. The position, orientation and height of the clamping plate has not limit such that the clamping plate has reduced thickness and height. Therefore, the computer keyswitch has lower height but with same level mechanism height and structural strength.

The various objects and advantages of the present invention will be more readily understood from the following detailed description when read in conjunction with the appended drawing, in which:

DETAILED DESCRIPTION OF THE INVENTION

Figure 1:
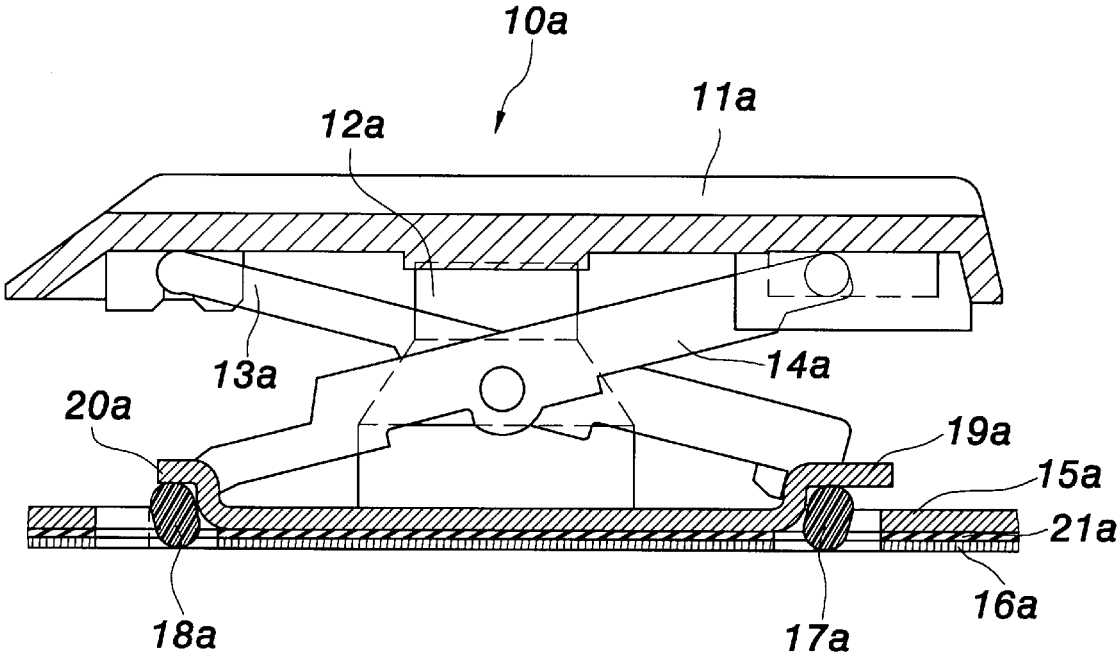
FIG. 1 PRIOR ART
FIG. 1 is a section view of prior art computer keyswitch.
Figure 2:
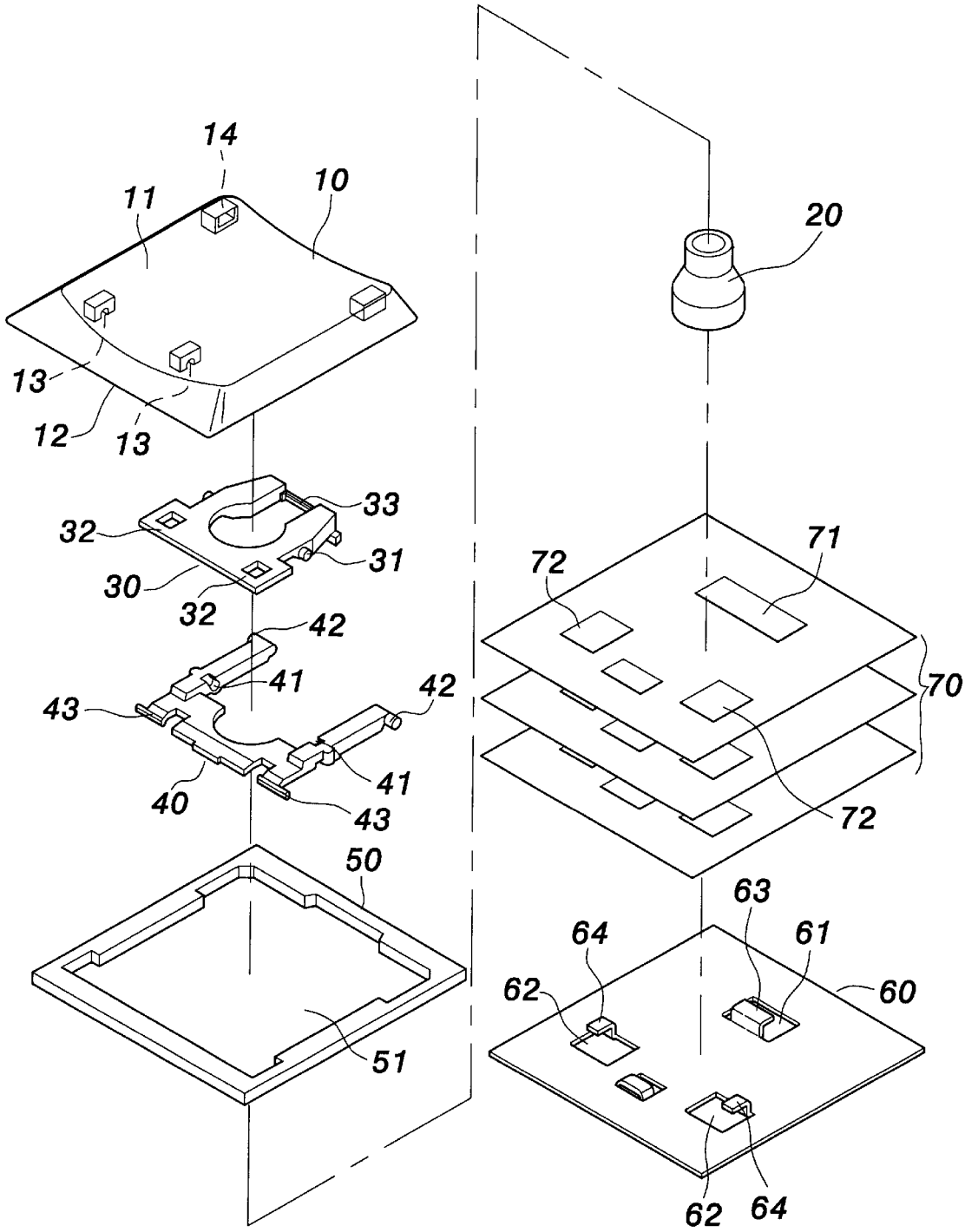
FIG. 2 is the exploded view of the computer keyswitch of the present invention.
Figure 3:
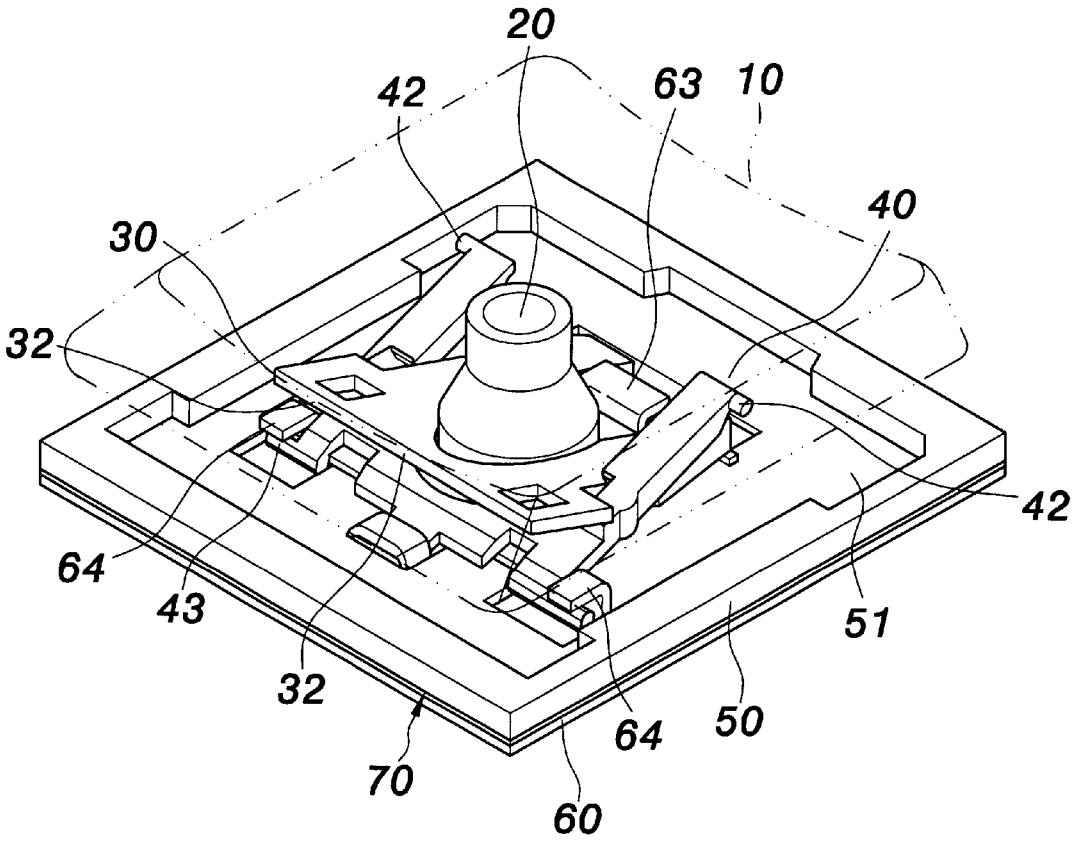
FIG. 3 is the perspective view of the computer keyswitch of the present invention.
Figure 4:
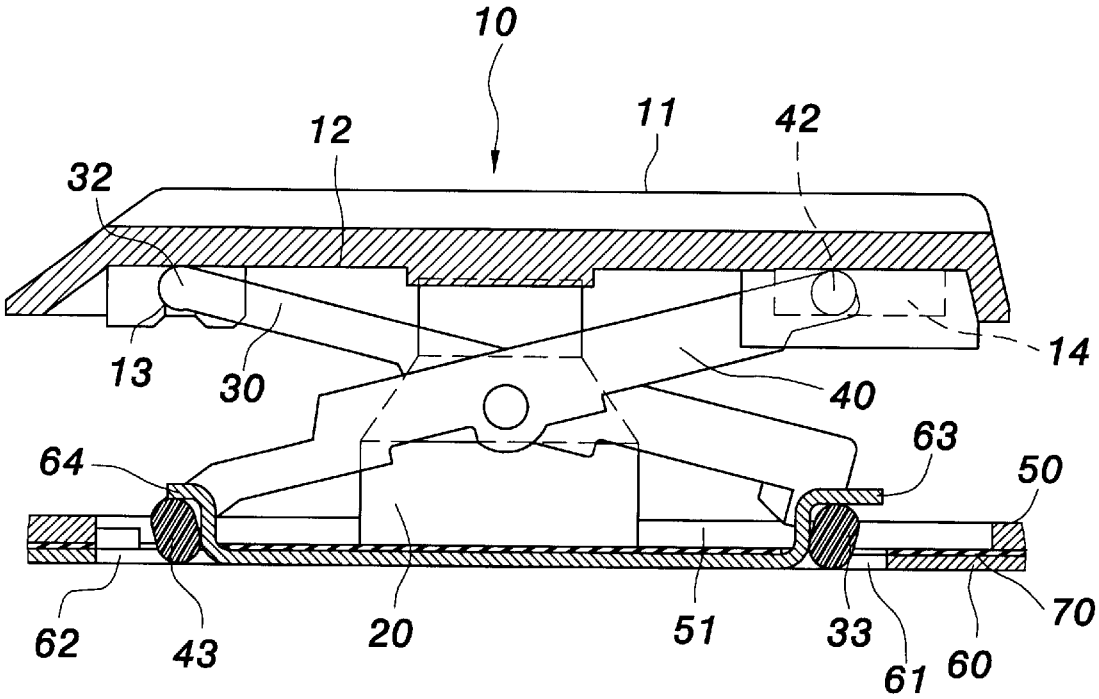
FIG. 4 is the sectional view of the computer keyswitch of the present invention.

With reference now to FIGS. 2 to 4, the present invention provides a computer keyswitch, which comprises a keycap 10, a resilient body 20, a first lever 30, a second lever 40, a base 50 and a bottom plate 60 and a membrane circuit 70. The keycap 10 is of rectangular plate shape and has an operating surface 11 and a mounting surface 12. The mounting surface 12 has two pivotal holes 13 and two sliding grooves 14.

The resilient body 20 is placed below the keycap 10 and within the movement stroke of the keycap 10.

The first lever 30 and the second lever 40 are arranged between the mounting surface 12 and the base 50. The first lever 30 and the second lever 40 have corresponding pivotal shafts 31 and pivotal holes 41 on center part thereof, respectively, such that the first lever 30 and the second lever 40 are arranged in scissors fashion. The first lever 30 has two pivotal shafts 32 on two top ends thereof and the second lever 40 has two sliding shafts 42 on two top ends thereof. The first lever 30 and the second lever 40 are assembled to the mounting surface 12 by pivotally assembling the two pivotal shafts 32 to the two pivotal holes 13 and slidably assembling the two sliding shafts 42 to the two sliding grooves 14. The first lever 30 has a pivotal shaft 33 on bottom side thereof and the second lever 40 has two pivotal shafts 43 on two bottom ends thereof such that the first lever 30 and the second lever 40 are pivotally assembled to the bottom plate 60.

The base 50 is placed below the keycap 10, the first lever 30 and the second lever 40, and has a specific thickness. The base 50 has an accommodating space 51 thereon and the first lever 30 and the second lever 40 are placed atop the accommodating space 51. Therefore, the first lever 30 and the second lever 40 can be accommodated by the accommodating space 51.

The bottom plate 60 is placed below the base 50 and is a plate with thinner thickness. Nevertheless, the thickness can be changed according to practical situation. The bottom plate 60 has a plurality of through holes 61 and 62 corresponding to the pivotal shafts 33 and 43 of the first lever 30 and the second lever 40. The pivotal shafts 33 and 43 of the first lever 30 and the second lever 40 are pivotally assembled into the through holes 61 and 62 of the bottom plate 60. The bottom plate 60 has a plurality of clamping plates 63 and 64 extended from topside of the through holes 61 and 62 of the bottom plate 60. The clamping plates 63 and 64 are used to confine upward motion of the pivotal shafts 33 and 43 of the first lever 30 and the second lever 40. The position, orientation and height of the clamping plates 63 and 64 have not limit as long as the clamping plates 63 and 64 can confine upward motion of the pivotal shafts 33 and 43 of the first lever 30 and the second lever 40. In the preferred embodiment of the present invention, each of the clamping plates 63 and 64 has reversed-L shape. The number of the clamping plates 63 and 64 can also be changed according to practical usage. In the preferred embodiment of the present invention, the number of the clamping plate 63 is 1 and the number of the clamping plate 64 is 2. The two clamping plates 64 are located at front side and the clamping plate 63 is located at rear side and between the two clamping plates 64 such that the clamping plates 63 and 64 form a triangular pattern.

The membrane circuit 70 is placed atop the bottom plate 60 and below the resilient body 20. The membrane circuit 70 has a plurality of through holes 71 and 72 corresponding to the pivotal shafts 33 and 43 on bottom of the first lever 30 and the second lever 40. Therefore, the pivotal shafts 33 and 43 on bottom of the first lever 30 and the second lever 40 are pivotally assembled into the through holes 61 and 62 of the bottom plate 60.

Figure 5:
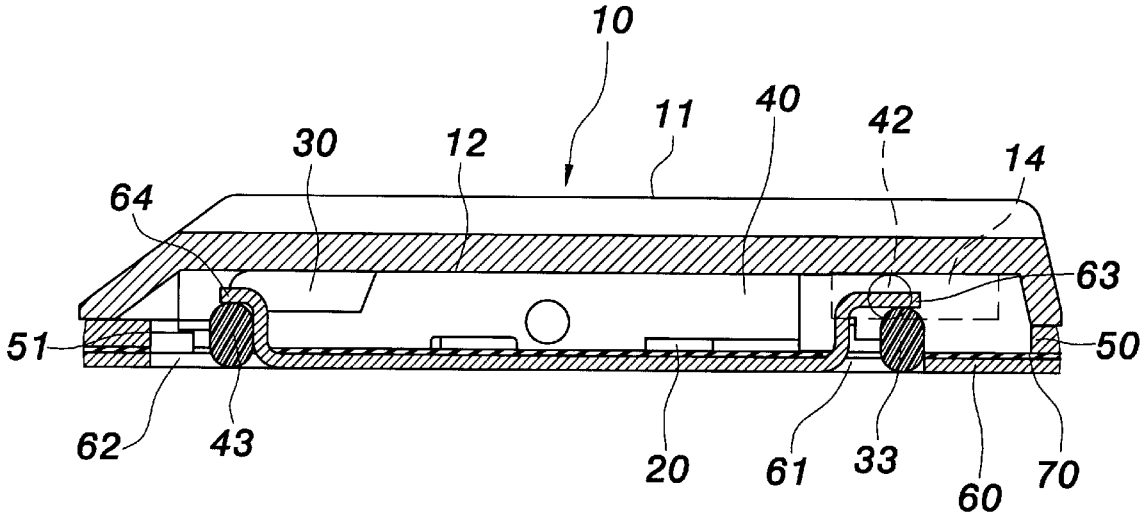
FIG. 5 is the sectional view of the computer keyswitch of the present invention in a pressed down state.

As shown in FIG. 5, when the keycap 10 is guided by the level mechanism composed of the first lever 30 and the second lever 40 to move downward or upward, the resilient body 20 below the keycap 10 presses on a membrane circuit 70 or leaves the membrane circuit 70 to perform on and off operation of the membrane circuit 21*a*. When the keycap 10 is guided by the first lever 30 and the second lever 40 to move downward, the first lever 30 and the second lever 40 sink into the accommodating space 51. Therefore, the overall height of the keyswitch is reduced while the movement stroke of the keyswitch is not changed. Moreover, the accommodating space 51 enable the first lever 30 and the second lever 40 to assemble from bottom of the base 50.

The present invention is characterized in that the clamping plates 63 and 64 are extended from the bottom plate 60. The thickness of the bottom plate 60 has not limit and can adopt thinner thickness. Therefore, the clamping plates 63 and 64 can also have thinner thickness. The pivotal shafts 33 and 43 on bottom of the first lever 30 and the second lever 40 are retained by the clamping plates 63 and 64. Therefore, the height of the pivotal shafts 33 and 43 can also be reduced. The keyswitch has lower height but with same level mechanism height and structural strength.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A computer keyswitch, comprising:

a bottom plate having a plurality of through holes formed therein, said bottom plate having a predetermined thickness and a plurality of clamping plates extending upwardly therefrom and respectively across said plurality of through holes;

a membrane circuit overlaying said bottom plate and having a plurality of apertures formed therein in respective aligned relationship with said plurality of through holes and through which said plurality of clamping plates respectively extend;

a base overlaying said membrane circuit, said base having an opening formed therethrough, said plurality of clamping plates extending into said opening, said base having a thickness greater than said predetermined thickness of said bottom plate;

a resilient body disposed in said opening of said base and having a lower end disposed on said membrane circuit;

a keycap having a mounting surface on a bottom side thereof, said resilient body having an upper end contacting said bottom side of said keycap; and, a first lever and a second lever disposed in a scissors arrangement between said mounting surface of said keycap and said bottom plate, said first and second levers having respective top ends assembled to said mounting surface and respective bottom ends formed with pivotal shafts, said pivotal shafts being respectively disposed in said through holes of said bottom plate and respectively captured therein by said plurality of clamping plates.

* * * * *